United States Patent [19]

Bouadjadja

[11] Patent Number: 5,007,113

[45] Date of Patent: Apr. 16, 1991

[54] CLOTHING, ESPECIALLY OF THE PULLOVER TYPE

[76] Inventor: Robert Bouadjadja, 133 rue Antoine-Durafour, 42100 St. Etienne, France

[21] Appl. No.: 358,348

[22] PCT Filed: Apr. 24, 1988

[86] PCT No.: PCT/FR88/00425

§ 371 Date: Apr. 27, 1989

§ 102(e) Date: Apr. 27, 1989

[87] PCT Pub. No.: WO89/01743

PCT Pub. Date: Mar. 9, 1989

[51] Int. Cl.[5] ..... A41B 1/00; A41B 1/02; A41B 1/18; A41D 27/08

[52] U.S. Cl. ..... 2/115; 2/80; 2/90; 2/106; 2/244; 446/28

[58] Field of Search ..... 2/74, 80, 49 R, 83, 2/106, 115, 118, 119, 120, 121, 160, 243 B, 244, 90; 446/26, 27, 28; 40/586

[56] References Cited

U.S. PATENT DOCUMENTS

| | | | |
|---|---|---|---|
| 2,686,313 | 8/1954 | Siedler | 2/75 X |
| 2,705,803 | 4/1955 | Sheldrick et al. | 2/8 |
| 3,608,092 | 9/1971 | Taranto | 2/49 R |
| 3,705,836 | 12/1972 | Francis et al. | 101/94 |
| 3,724,101 | 4/1973 | Slezak | 2/74 X |
| 3,777,310 | 12/1973 | Yang | 2/48 |
| 4,365,353 | 12/1982 | Rayl | 2/115 |
| 4,543,669 | 10/1985 | Katz | 2/84 |
| 4,591,521 | 5/1986 | Freno et al. | 2/80 X |
| 4,631,210 | 12/1986 | McGee et al. | 40/406 |
| 4,662,550 | 5/1987 | O'Donnell | 446/26 |
| 4,710,979 | 12/1987 | Bull et al. | 2/75 |
| 4,723,323 | 2/1988 | Wright | 2/244 X |
| 4,772,503 | 9/1988 | Donsky | 2/115 X |
| 4,813,081 | 3/1989 | Cliff et al. | 2/115 X |
| 4,815,149 | 3/1989 | Erhardt et al. | 2/244 X |
| 4,829,601 | 5/1989 | Spanier | 2/49 R |
| 4,837,864 | 6/1989 | Thill | 2/115 X |

FOREIGN PATENT DOCUMENTS

| | | | |
|---|---|---|---|
| 88/02605 | 4/1988 | World Int. Prop. O. | 2/244 |

*Primary Examiner*—Werner H. Schroeder
*Assistant Examiner*—Jeanette E. Chapman
*Attorney, Agent, or Firm*—Eckert Seamans Cherin & Mellott

[57] ABSTRACT

The subject matter of the invention is related to sewing technology. The pullover-type garment according to the invention is remarkable in that the front and/or the back part display, in a matching manner, one or more decorative elements (2) depicting animals or characters which are attached and provided with suitable means for throwing said elements (2) into relief and for leaving the right side and wrong side of the part of the garment receiving said decorative element(s) free from any roughnesses and seams.

4 Claims, 2 Drawing Sheets

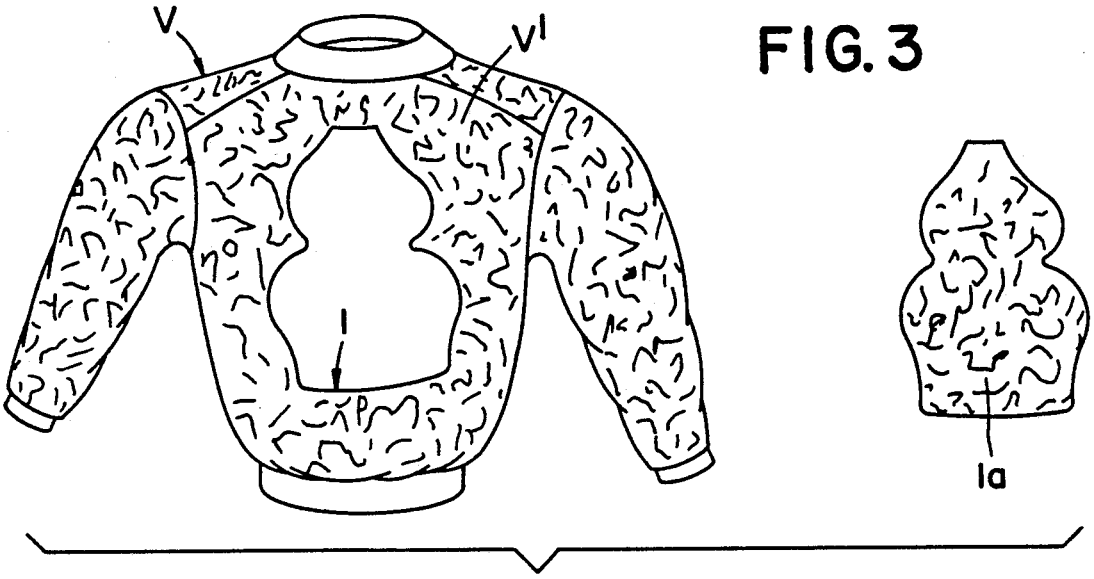
FIG. 3
FIG. 4
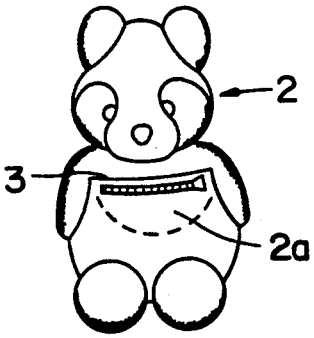
FIG. 5
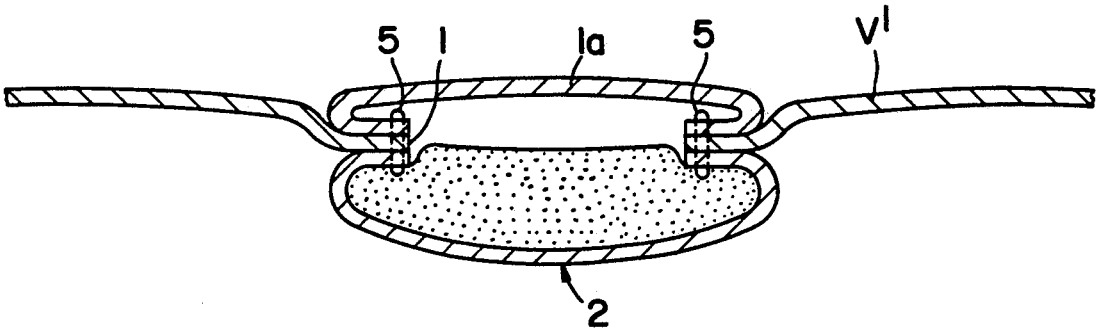

CLOTHING, ESPECIALLY OF THE PULLOVER TYPE

The object of the present invention pertains to the technical sector of sewing.

The production of figurine-type decorative elements representing material objects, persons or others on clothing is known. In general, in most cases, these decorative elements are produced by sewing or embroidering directly on a part of clothing, especially on the front or the back.

This mounting process has certain disadvantages. In fact, it is necessary to place on the reverse on the fabric, in counterpart to the decorative element, a piece of paper or other material, with the function of partially suppressing the elasticity of the fabric and subsequently to add tension to the said decorative element which is sewn or embroidered in conjunction with the paper countersupport. After attaching the decorative element, one manually removes the excess paper following the outline of the said element.

A problem with comfort results for the user when wearing the clothing because the stitches remain visible, on the one hand, and the paper can be directly in contact with the skin, on the other hand. Moreover, this mode of attachment does not make it possible to put in relief the decorative element which remains in the same plane as the part of the clothing receiving it.

To remedy these disadvantages, the goal of the present invention is to manufacture clothing of the pullover type having a decorative element with a relief appearance, without being detrimental to the comfort of the user, the reverse of the clothing, especially the part having the decorative element, always having the same feel as the rest of the entire clothing.

In this regard, the process is noteworthy in that it comprises the following principal steps:

On the front or back part, a cutout is made, the outline of which corresponds to that of the decorative element(s).

The decorative element(s) are made independently.

The decorative element(s) are inserted into the cutout opening.

On the reverse of the front or back part, the piece of fabric initially cut out is added to the outline(s) of the decorative element(s).

The element(s) and the previously cut-out piece are sewn together according to the so-called sleeve mounting principle.

The invention is described below in greater detail using the attached drawings by way of example and in which:

FIG. 2 through 5 show the principal phases of the process in purely schematic views.

To make the object of the invention more concise, it is described in nonlimiting embodiments schematically shown in the figures of the drawings.

Figure 1:
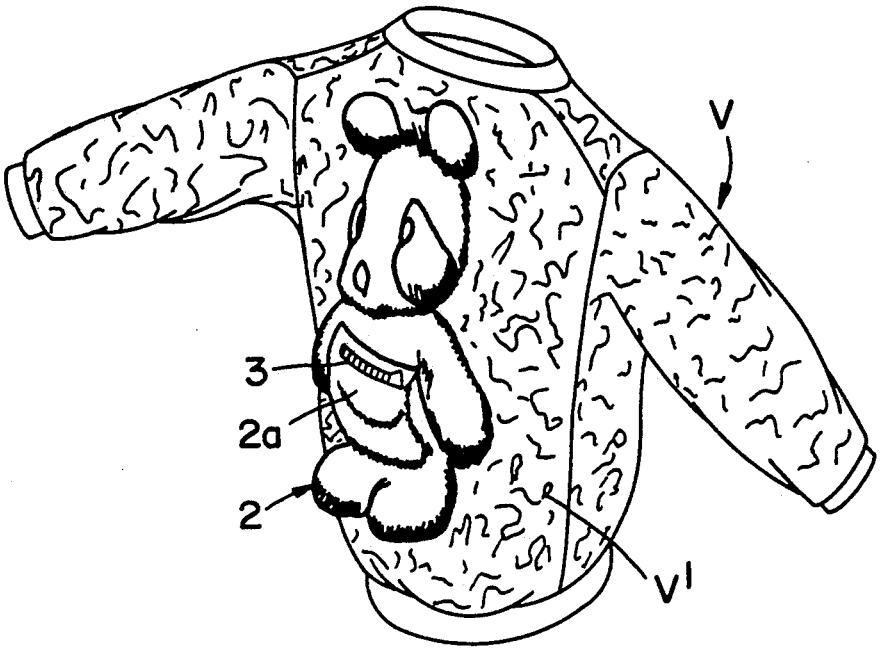
FIG. 1 is a perspective view of a pullover according to the invention.
Figure 2:
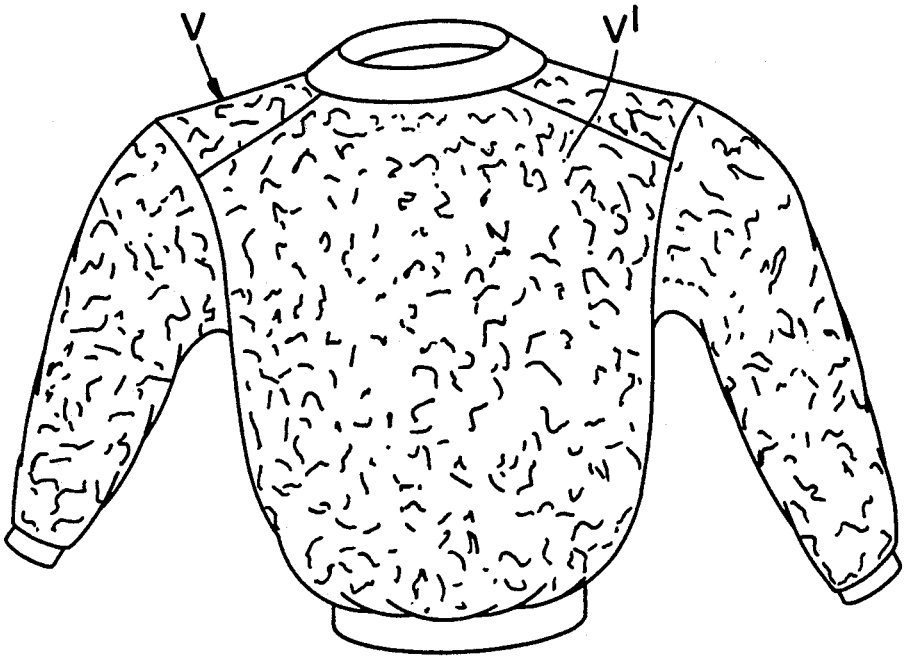

The entire article of clothing of the pullover or other type, which is manufactured by any known suitable means, is designated by (V). Any kind and density of thread can be used (FIG. 2).

According to the invention, from the front (VI) (or the back), one makes a cutout (1), the outline of which corresponds to that of the decorative element (2) selected to fit the clothing (FIG. 3).

The decorative element (2) is made separately by any known means (FIG. 4). Preferably, though not strictly limiting, the element (2) is made in a fabric that is different from that of the clothing so as to increase the relief effect. It is known that the decorative element can consist of any figurine (animal, person) as well as any material object. As an indication, the clothing (V) is made in a smooth fabric, while the decorative element has a fluffy appearance.

The decorative element (2) is then inserted over the cut-out opening (1) of the front (or back). On the reverse of the front (or back) and in correspondence with the decorative element (2), the piece of fabric (1*a*) initially cut out is then placed behind the element and along the contours of the said element (2) on the inner surface of the article of clothing as shown in the drawings (FIG. 5).

Finally, one proceeds with stuffing the decorative element, entirely or partially, to give it the desired visual effect, with a relief appearance.

In a particularly noteworthy manner, a sewing operation according to the known so-called sleeve mounting principle is carried out to attach the decorative element (2) to the previously cut-out piece (1*a*). The sleeve mounting principle involves folding the edges of each inserted element underneath that element. The folded-under edge of each inserted element is placed against the article of clothing, thus forming a three layer edge construction or sleeve as shown in FIG. 5. Access for sewing along the perimeter of the cutout opening is obtained through the open ends of the sleeve, which thereafter can be closed. This particular method of assembling by sewing makes it possible to avoid the appearance of stitches (5) on the reverse side of the clothing with the decorative element. A reverse that is uniformly smooth and devoid of any unevenness is obtained.

Considering the particular method of attaching the decorative element resulting from the process according to the invention, it is possible to equip it with suitable means to fulfill a function, for example. The decorative element (2) can have a cutout (2*a*) to give access to a pocket, capable of being closed by a closing-type means with zippers (3).

The advantages are clearly evident from the description. In particular, the visual effect produced by the decorative element, which appears in relief and which can also act as means with a functional character (pocket, purse), is emphasized.

After finishing, the inside of the clothing, on the reverse side, remains extremely smooth in the same manner as clothing not having a decorative element.

The invention is applicable to all types of clothing whatever the shapes and sizes may be.

I claim:

1. An article of clothing comprising:

a fabric layer suitable for wearing;

at least one decorative element attached to an outer surface of said fabric layer, said at least one decorative element being stuffed with material to form a relief;

at least one inner layer attached to an inner surface of said fabric layer along the contours of said at least one decorative element; and, wherein an inside of said fabric layer is smooth and stitchless.

2. A method of attaching a decorative element to clothing, comprising the steps of:

removing a single piece of fabric from the clothing to form a cutout opening, said single piece of fabric corresponding in size and shape to the decorative element to be attached;

folding under an edge around the perimeter of both the decorative element and the single piece of fabric;

inserting the decorative element and the single piece of fabric over the cutout opening such that the edges contact the clothing on opposite sides; and sewing the edges to the clothing.

3. The method according to claim 2, further comprising the step of stuffing the decorative element with a suitable material to form a relief.

4. The method according to claim 2, further comprising the step of forming a storage compartment in the decorative element.

* * * * *